United States Patent [19]

Curtis

[11] 4,004,141

[45] Jan. 18, 1977

[54] LINEAR/LOGARITHMIC ANALOG MULTIPLIER

[76] Inventor: Douglas R. Curtis, 1235 Wildwood Ave., Apt. 179, Sunnyvale, Calif. 94086

[22] Filed: Aug. 4, 1975

[21] Appl. No.: 601,610

[52] U.S. Cl. ..... 235/194; 307/229; 328/145

[51] Int. Cl.[2] ..... G06G 7/16; G06G 7/24

[58] Field of Search ..... 235/194, 197, 195, 196, 235/193; 328/145; 324/132; 307/229

[56] References Cited

UNITED STATES PATENTS

| | | | |
|---|---|---|---|
| 3,152,250 | 10/1964 | Platzer, Jr. | 235/194 X |
| 3,329,836 | 7/1967 | Pearlman et al. | 328/145 X |
| 3,492,497 | 1/1970 | Gilmour et al. | 235/197 X |
| 3,676,661 | 7/1972 | Sprowl | 328/145 X |
| 3,714,462 | 1/1973 | Blackmer | 328/145 X |

*Primary Examiner*—Joseph F. Ruggiero
*Attorney, Agent, or Firm*—Dirk J. Veneman

[57] ABSTRACT

An analog device for generating an output signal which is proportional to the linear product between a first input signal and the antilogarithm of the second input signal, and comprising a means for applying the second input signal simultaneously and identically across the base-emitter junction of two electrically matched transistors; a means for summing each differential component of the first input signal with the second input signal across one of the same base-emitter junctions is provided; and further including a means for differencing the signals developed in the collectors of the two transistors so that the output signal is comprised only of the desired product of the two input signals.

28 Claims, 3 Drawing Figures

LINEAR/LOGARITHMIC ANALOG MULTIPLIER

BACKGROUND OF THE INVENTION

The present invention relates to analog multipliers, and more particularly, multipliers operating in two quadrants and including novel means for conveniently generating an electrical output signal which is the linear product of two input signals or the linear product of the first input signal and the antilogarithm of the second input signal.

The most common method of performing two quadrant multiplication has been to vary the transconductance and hence the amount of amplification of a differential pair of transistors by varying the magnitude of the current being supplied to the junction of the two emitters of the transistor pair. One of the signals to be multiplied is converted to this current and the other signal is applied differentially to the bases of the transistor pair. The output signal is usually taken differentially from the two collectors of the transistor pair and contains only the linear product of the two input signals as expressed by the following general equation:

$$So = K\, S_1 \,.\, S_2 \qquad (1)$$

where $So$ is the output signal, $S_1$ and $S_2$ are the two input signals, and $K$ is a constant of proportionality.

In many electronic devices which utilize analog multipliers, such as voltage controlled oscillators, voltage controlled amplifiers, and voltage controlled filters and phase shifters, it is often desirable that the output parameter of the device be proportional to the antilogarithm of the input control signal. Such requirements are found in linear/logarithmic function generators and electronic musical instruments. Hence, the multiplier comprising such devices must generate the linear product between a first input signal and the antilog of a second input signal, that is:

$$So = K\, a^{S_2} \,.\, S_1 \qquad (2)$$

where $So$ is the output signal, $S_1$ and $S_2$ are the first and second input signals respectively, and $K$ and $a$ are constants.

In order to make the differential transistor pair type of multiplier capable of generating the antilog product function expressed by equation (2), the current supplying the transistor pair would be generated by an antilog converter, the magnitude of this current hence being the antilog of one of the input signals.

Although this method is feasible, it is indirect and requires a considerable amount of additional circuitry. Thus, it would be advantageous to provide a means for more directly and simply generating the antilog product function.

OBJECTS AND SUMMARY OF THE INVENTION

Accordingly, a principle object of present invention is to provide a multiplier capable of conveniently generating not only the linear product function as expressed by equation (1), but also the antilog product function as expressed by equation (2). This object may be accomplished by the use of the relationships governing many transistors of high gain, such as the silicon planar types, where the collector current very nearly equals the emitter current; and where the collector current, Ic, will be proportional to the antilog of the base-emitter junction voltage, Vbe, over a wide range of collector currents as approximated by the following relationship:

$$Ic = Is \,.\, e^{Vbe/h},\ h = KT/q \qquad Ic >> Is \qquad (3)$$

where $e$ is the natural logarithm base, $Is$ is the bulk saturation current of the junction, $T$ is the junction temperature, and $K/q$ is a constant. If a voltage $Vc$ is applied with a negative polarity with respect to ground to the emitter of such a transistor, and a voltage $Vs$ is applied with respect to ground to the base of the same transistor, thus effectively summing these two voltages across the base-emitter junction of the transistor, the collector current will be related to the input voltages by the following expression:

$$Ic = Is.\ e^{(Vs + Vc)/h} = Is.\ e^{Vs/h}.\ e^{Vc/h} \qquad (4)$$

If $Vs$ is kept small (i.e. $|Vs| < h$), $e^{Vs/h}$ describes a function which is nearly linear with respect to $Vs$ and thus the collector current will be essentially a linear product of the input signal $Vs$ and the antilog of the input signal $Vc$. The voltage $Vc$ can only be of one polarity and is customarily referred to as the control voltage. As $Vs$ is kept small in comparison to $Vc$, it may be of either polarity and is customarily referred to as the signal voltage. Hence, this simple circuit configuration generates the desired antilog product function in two quadrants, where the collector current of the transistor is the output signal.

In most applications, if a multiplier of any kind is to be useful, its output signal must be comprised of only the desired product of the two input signals. In the circuit just described, however, the output signal contains not only the antilog product signal, but in addition another signal which is a function only of the control voltage, $Vc$, and which is considerably larger than the product signal. That is, if the signal voltage, $Vs$, in equation (4) is made zero, that portion of the output signal which is the antilog product signal will also diminish to zero, leaving in the output the undesired signal component, namely, $Is.e^{Vc/h}$. This phenomenon is normally referred to as control voltage feedthrough, and another important object of the present invention is to provide a means to suppress or eliminate this feedthrough of the control signal into the output so that the output signal of the multiplier contains only the desired product of the two input signals.

Thus, in accordance with the principles of the present invention, this object as well as the first object is accomplished by applying the control voltage, $Vc$, simultaneously with equal magnitude and polarity across the base-emitter junctions of two transistors matched to exhibit the same electrical characteristics and subjected to the same thermal environment to maintain the base-emitter junctions of both transistors at the same temperature. The signal voltage, $Vs$, is applied differentially to the same base-emitter junctions of the two transistors, where each opposite polarity component is summed with the control voltage across the respective base-emitter junction. Because the two transistors are electrically identical and their base-emitter junctions are at the same temperature and the same control voltage is applied to each, each transistor will develop $e$ in its collector signal the same undesired component as a function of only the control voltage, namely $Is.e^{Vc/h}$. But because the signal voltages applied to each transistor are of opposite polarity to each other, the antilog product signal generated in each collector signal will be also of opposite polarity. A means is provided to subtract one collector signal from the other collector signal so that the output signal comprises the difference between the two collector signals. The two undesired components, $Ise.^{Vc/h}$, developed in each collector, being identical in magnitude and polarity, will cancel each other, while the two antilog product signals, being of opposite polarity, will reinforce each other. Thus, the unwanted component as a function of only the control voltage will be effectively eliminated from feeding through to the output.

Applying the input signal voltage, $Vs$, as a differential voltage to the two transistors as described is the general case of operation. Similar results may be obtained by applying the input signal, $Vs$, as a single ended voltage to just one of the base-emitter junctions. A differential signal may be defined as two signals which vary with respect to a common point in an identical manner but with opposite polarity.

The base-emitter junctions of both transistors are maintained at the same temperature by providing a thermal path of low resistance between the two junctions. A low thermal resistance connection is typically accomplished by mounting the two transistors on a common heat sink, or processing both transistors monolithically on a common substrate.

There are numerous methods for providing an output which is the difference of the signals developed in the collectors of the two matched transistors. The two collector signals, whether voltages or currents, may be fed to the inputs of a differential voltage or current amplifier. Another such differencing means may be realized by inverting the polarity of one of the collector voltages and summing this inverted voltage with the collector voltage of the other transistor. Another differencing means is realized by inverting the polarity of the collector current of one of the transistors with a current mirror and adding this inverted current to the collector current of the other transistor. Use of any of these or other such means of generating a difference signal are fully within the scope of this invention.

In the relationship set forth in equation (4), the collector current is not only a function of the total voltage across the base-emitter junction, but is also a function of the junction temperature, and therefore the magnitude of the output signal of the basic two-transistor multiplier circuit herein above described is dependent upon ambient temperature. One temperature effect appears in the parameter $h$ of equation (4) and causes the gain of the multiplier to diminish by 0.33% for every degree centigrade increase in temperature around 27° C. The quantity, $Is$, being essentially equal to the reverse leakage current of the base-emitter junction, approximately doubles with every 10° centigrade increase in temperature for typical silicon transistors, causing the multiplier gain to increase roughly 10% for every degree centigrade increase in temperature. Therefore, another object of the present invention is to provide a means for reducing or eliminating the dependence of gain on temperature.

The temperature effect of $Is$, which is by far the most dominant, may be eliminated by use of a third diode junction electrically matched to and maintained at the same temperature as the base-emitter junctions of the two transistors comprising the basic multiplier circuit hereinabove described. A means is provided for maintaining a constant reference current, $Ir$, through this third junction, summing the control voltage, $Vc$, with this third junction voltage, and applying this summed voltage instead of the control voltage, $Vc$, alone simultaneously to the base-emitter junctions of the two transistors comprising the basic multiplier circuit. The third junction voltage may be expressed as:

$$Vr = h_1 . \ln (I_r/Is_r) \quad (5)$$

where $Is_r$ is the bulk saturation current of this third junction. The expression for $Vc + Vr$ is substituted for $Vc$ in equation (4), and by letting $Isr = Is$, because the junctions are electrically matched, and $h_1 = h$, because the junctions are at the same temperature, the new equation for the collector current of each of the two transistors becomes:

$$Ic = Ir.e^{Vc/h}. e^{\pm Vs/h} \quad (6)$$

The temperature dependent current, $Is$, is replaced by the temperature independent constant, $Ir$. Alternatively, the temperature compensation may be implemented by summing the third diode junction voltage, $Vr$, with the signal voltage $Vs$, and applying this summed voltage differentially to the base-emitter junctions of the two transistors comprising the basic multiplier circuit. The result is again the virtual elimination of the temperature variable quantity, $Is$. With the use of the above temperature compensation techniques, the only temperature effect on gain is the −0.33% of the coefficient $h$. This final temperature effect may be reduced by the use of resistors with an opposite temperature coefficient.

While other means for eliminating the temperature dependence of gain may exist, use of these means does not depart from the scope of the present invention.

Although the present invention is conveniently suited to generating the linear product of one input voltage and the antilog of the other input voltage, another objective is to make the multiplier capable of generating the normal linear product between the two inputs as expressed by equation (1) as well as the antilog product. The linear product may be obtained by generating a voltage which is proportional to the logarithm of the input control signal and applying this voltage simultaneously to each base emitter junction of the two matched transistors comprising the basic multiplier circuit herein above described. Therefore, if the quantity $K.\ln Vc$ is substituted for $Vc$ in equation (4), and if $k = h$, the new expression for the collector currents developed in the two transistors becomes:

$$Ic = Is.Vc.e^{\pm Vs/h} \quad (7)$$

These two collector currents are subtracted at the output by a differencing means to eliminate the undesired component, $Is.Vc$. If $Vs$ is kept small, the output signal will be essentially proportional to the linear product of the two input voltages, $Vc$ and $Vs$.

In the preceding description of the present invention, the quantity $e^{Vs/h}$ has been assumed to be nearly linear with $Vs$. In actuality, non-linearities in the output product will exist due to the non-linear function, $e^{Vs/h}$, and will become increasingly non-linear as the magnitude of $Vs$ is increased. That is, the output signal will deviate slightly from the desired output signal as expressed by equations (1) or (2), this deviation becoming greater for larger values of $Vs$. Another object of the present invention is to provide a means for reducing or eliminating the non-linearities in the output signal.

In a manner similar to that in which the antilog function of the control voltage, $Vc$, in equation (4) is converted to the linear function of, $Vc$, in equation (7), the necessary linearization of the $Vs$ term may be accomplished by generating the logarithm of the input signal voltage, $Vs$, and applying this voltage differentially to the base-emitter junctions of the two matched transistors comprising the basic multiplier circuit herein above described.

Besides the simplicity and directness in generating the linear or antilog product function, the present invention offers another convenient feature. In many applications requiring multipliers, two or more multipliers must be ganged together such that each output product signal is a function of a common input multiplying signal. Mathematically expressed, a ganged multiplier provides independent multiple outputs; $V_{o1}$, $V_{o2} \ldots V_{on}$, such that:

$$V_{o1} = Vx.\ V_1$$

$$V_{o2} = Vx.\ V_2$$

$$\vdots$$

$$V_{on} = Vx.\ V_n$$

where $k$ is a constant and where each of the multiple input signals $V_1$. $V_2 \ldots V_n$ are simultaneously multiplied by the common input signal, $Vx$. The ganging of conventional multipliers is inefficient, but the ganging of the multiplying elements utilizing the teachings of the present invention is direct and eloquent.

The common multiplying voltage, $Vx$, is applied simultaneously with equal magnitude and polarity across the base-emitter junctions of a plurality of electrically matched transistors. Each of the multiple input signals is applied either differentially to the base-emitter junctions of two of the transistors, or single-endedly to the base-emitter junction of one of the transistors, and thereby summed with the common voltage $Vx$ across that particular junction. For the reasons herein previously given, each of the collector signals of the transistors will consist of an undesired component which is a function only of the common control voltage, $Vx$, and a desired component which is the linear product of one of the multiple input signals and the antilog of the common voltage, $Vx$. At least one of the transistors may have only the common voltage, $Vx$, applied across its base-emitter junction and, therefore, will develop only the undesired component in its collector signal.

Means are provided so that each of the multiple outputs is proportional to the difference between two of the collector signals in order that the undesired component is eliminated from that particular output.

The methods utilized in conjunction with the single multiplier as previously described may also be used with the ganged multiplier configuration to provide linear product outputs as well as antilog product outputs, to temperature compensate the collector currents of the transistors, or to linearize the output signals by the logarithmic conversion of the input signals.

Other objects and special features of the invention will become apparent from the following description of the drawings. The invention accordingly comprises any electronic device or apparatus incorporating the combination of elements and arrangement of parts which are exemplified in the following detailed disclosure, and the scope of the application of which will be indicated in the claims. It will be apparent to those skilled in the art that although the invention has primarily been described as utilizing transistors, other semi-conductor devices may in certain instances be substituted.

BRIEF DESCRIPTION OF THE DRAWINGS

For a fuller understanding of the nature and objects of the present invention, reference should be had to the following detailed description taken in connection with the accompanying drawings wherein.

Figure 1:
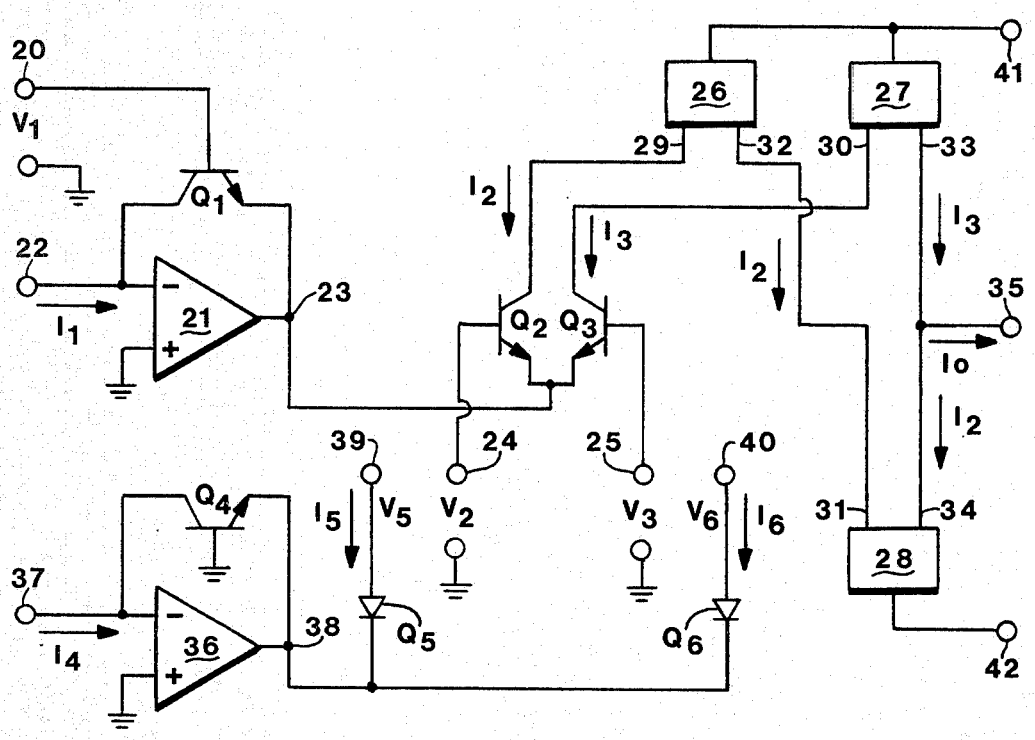
FIG. 1 is a schematic circuit diagram, illustrating one embodiment of the present invention.

DESCRIPTION OF THE PREFERRED EMBODIMENTS:

Referring now to FIG. 1, there is shown a general schematic diagram of a preferred embodiment of the present invention, including transistors Q2 and Q3 forming the basic multiplying transistor pair, including operational amplifier 21 and transistor Q1 providing the temperature compensation means and a logarithmic conversion means for input current $I_1$, including current mirrors 26, 27, and 28 providing the collector signal differencing means, and including operational amplifier 36 in conjunction with transistor Q4 and diode connected transistors Q5 and Q6 providing the temperature compensated logarithmic conversion means for input signal currents $I_5$ and $I_6$, whereby transistors Q1, Q2, and Q3 are electrically matched and mounted on a common substrate, and transistors Q4, Q5, and Q6 are electrically matched and mounted on a common substrate. Not shown, for purposes of clarity, are the plus and minus power supply voltages, providing power to the operational amplifiers and to points 41 and 42 respectively. The following is a detailed description and mathematical derivation of this circuit in accordance with the principles of the present invention.

The input control voltage, $V_1$, is applied with respect to ground to input terminal 20 and thereby to the base of transistor Q1, which is connected in the feedback loop of operational amplifier 21 having high open loop gain and low input bias currents. A reference current, $I_1$, is sourced into input terminal 22 and thereby into the inverting input of amplifier 21, the major portion of $I_1$ being maintained by amplifier 21 through the base-emitter junction of transistor Q1 regardless of the emitter currents of transistors Q2 and Q3. Since input terminal 22 is at a virtual ground, the reference current may be conveniently generated by applying a reference voltage to a resistor connected to input terminal 22. The output 23 of amplifier 21 will be the sum of the input control voltage, $V_1$, and the base-emitter junction voltage of transistor Q1, referred to hereafter as $Vb_1$, which is a function of only the reference current $I_1$. This summed voltage at amplifier output 23 is then applied simultaneously to the emitters of transistors Q2 and Q3. Since transistors Q1, Q2, and Q3 are all electrically matched to each other, and their base-emitter junctions are maintained at the same temperature, the effect of the base-emitter junction voltage of transistor Q1 is to eliminate the temperature effect of the bulk saturation currents Is on the collector currents of transistors Q2 and Q3.

The signal input voltage or voltages are applied single-endedly with reference to ground to input terminal 24 or to input terminal 25, and thereby to the base of transistor Q2 or to the base of transistor Q3 respectively, or the signal input voltage is applied differentially to the bases of both transistors through input terminals 24 and 25. Let $V_2$ be the voltage applied to the base of transistor Q2 and $V_3$ be the voltage applied to the base of transistor Q3. The voltage across the base-emitter junction of transistor Q2, referred to hereafter as $Vb_2$ is the difference between the voltage at the emitter and voltage at the base, or $$Vb_2 = Vb_1 - V_1 + V_2 \quad (8)$$

In a similar manner, the voltage across the base-emitter junction of transistor Q3, referred to hereafter as $Vb_3$, is:

$$Vb_3 = Vb_1 - V_1 + V_3 \quad (9)$$

But the junction voltages $Vb_1$, $Vb_2$, and $Vb_3$ are also proportional to the logarithms of the currents through the respective junctions, or $$Vb_1 = h.ln\ (I_1/Is_1) \quad (10)$$

$$Vb_2 = h.ln\ (I_2/Is_2) \quad (11)$$

$$Vb_3 = h.ln\ (I_3/Is_3) \quad (12)$$

where $I_2$ is the collector current of transistor Q2, and $I_3$ is the collector current of transistor Q3, and $Is_1$, $Is_2$, and $Is_3$ are the bulk saturation currents of the base-emitter junctions of transistors Q1, Q2, and Q3 respectively. By combining equations 10, 11 and 12, with equations 8 and 9, and letting $Is_1 = Is_2 = Is_3$ for well matched transistors, and $h_1 = h_2 = h_3 = h$ for identical junction temperatures, the expressions for the collector currents of transistors Q2 and Q3 become respectively:

$$I_2 = I_1.e^{-V_1/h}.e^{V_2/h} \quad (13)$$

$$I_3 = I_1.e^{-V_1/h}.e^{V_3/h} \quad (14)$$

The collector current $I_3$ of transistor Q3 is fed to the input 30 of a current mirror 27 which generates an output current at 33 equal in magnitude but opposite in polarity to collector current $I_3$. The collector current $I_2$ of transistor Q2 is likewise fed to the input 29 of a similar current mirror 26 which feeds a current from the output 32 equal in magnitude but opposite in polarity to collector current $I_2$ to the input 31 of a third current mirror 28. The output current at 34 of this third current mirror 28, being an inversion of the current to the input 31 and hence equal in magnitude and polarity to the collector current $I_2$ of transistor Q2, is combined with the current from the output 33 of current mirror 27 at the final output terminal 35 of the multiplier circuit. The current Io from this output terminal 35 is, therefore, the difference between the collector currents of transistors Q2 and Q3, and may be expressed as:

$$Io = I_3 - I_2 = I_1\, e^{-V_1/h}\ (e^{V_3/h} - e^{V_2/h}) \quad (15)$$

If $V_2$ and $V_3$ are kept small ( $|V_2| < h$, $|V_3| < h$), the term $e^{V_3/h} - e^{V_2/h}$ will be nearly a linear function of the difference between $V_3$ and $V_2$. Therefore, the output current is proportional to the linear product of the input signal, $V_3 - V_2$ ($V_2$ and $V_3$ may be opposite polarity components of a differential input signal), the antilog of the voltage $V_1$, and the reference current $I_1$. The output current Io may be positive or negative, its polarity being dependent on the polarity of the input difference signal, $V_3 - V_2$.

The collector current of transistor 23 is inverted twice by current mirrors 26 and 28 in order that the output current Io may drive any load which is at a voltage either positive or negative. Thus, the output current signal may easily be converted to a voltage signal by feeding this output current through a resistor connected to ground. With typical types of current mirrors, the output negative and positive voltage excursions may become nearly as great as the negative and positive supply voltages.

In equation 15, the quantity $I_1$ has hereto been regarded as a constant reference current. If, however, the current $I_1$ were a variable control current, the multiplier output current as expressed by equation 15 would be proportional to the linear product of the variable input current, $I_1$, and the input difference signal voltage, $V_3 - V_2$. Thus this particular embodiment in FIG. 1 is capable of generating the normal linear product as well as the antilog product between two input signals.

This linear product generation capability is a result of the fact that the circuit configuration comprised of transistor Q1 in conjunction with amplifier 21 serves the purpose not only of temperature compensating the collector currents of transistors Q2 and Q3, but also of generating across the base-emitter junction of transistor Q1, and hence at the output 23 of amplifier 21, a voltage which is proportional to the logarithm of any current sourced into the inverting input terminal 22 of amplifier 21, and effectively applying this generated voltage simultaneously across the base-emitter junctions of transistors Q2 and Q3.

The control current $I_1$ may be made a function of an input control voltage by applying this input control voltage $V_4$ to a resistor with a value of R1 connected to the inverting input terminal 22 of amplifier 21. The relationship becomes:

$$I_1 = V_4/R_1 \quad (16)$$

and the output current is then expressed as:

$$Io = V_4/R_1\, e^{-V_1/h}\ (e^{V_3/h} - e^{V_2/h}) \quad (17)$$

In either case, the output signal is the linear product of the input control voltage $V_4$ or control current $I_1$, the input signal voltage difference, $V_3 - V_2$, and the antilog of the other control voltage $V_1$. A useful advantage of this particular circuit is its capability of generating both the linear product function and antilog product function simultaneously.

The circuitry shown in FIG. 1 also includes another logarithmic converted intended to linearize the $e^{V_3/h} - e^{V_2/h}$ term of equations 15 and 17 if desired. This temperature compensated logarithmic converter consists of transistor Q4 connected in the feedback loop of an operational amplifier 36 haaving high open loop gain and low input bias currents, and two diode connected transistors Q5 and Q6 with their cathodes connected to the output 38 of amplifier 36. The input signals are sourced as currents, $I_5$ and $I_6$, into input terminals 39 and 40 and thereby through diode connected transistors Q5 and Q6 respectively. A reference current $I_4$ is sourced into input terminal 37 and thereby into the inverting input of amplifier 36 and is maintained constant through the base-emitter junction of transistor Q4 by amplifier 36 regardless of the input signal currents $I_5$ and $I_6$. The voltages developed at the anodes of diode connected transistors Q5 and Q6 appear at the output terminals 39 and 40 respectively of the log converter, these voltages being the differences between the base-emitter junction voltage of transistor Q4 and the junction voltages across diode connected transistors Q5 and Q6 respectively. Each of these three junction voltages are proportional to the logarithm of the current flowing through that particular junction. Hence, the voltage at the output terminal 39, referred to hereafter as $V_5$, may be expressed as:

$$V_5 = h_5 \ln (I_5/Is_5) - h_4 \ln(I_4/Is_4) \quad (18)$$

where $Is_4$ and $Is_5$ are the bulk saturation currents of the base-emitter junction of transistor Q4 and the junction of diode connected transistor Q5 respectively.

The voltage at output terminal 40, referred to hereafter as $V_6$, may likewise be expressed as:

$$V_6 = h_6 \ln (I_6/Is_6) - h_4 \ln (I_4/Is_4) \quad (19)$$

where $Is_6$ is the bulk saturation current of the junction of diode connected transistor Q6. Since the base-emitter junctions of transistors Q4, Q5, and Q6 are all electrically matched to each other, $Is_4 = Is_5 = Is_6$, and since all three junctions are maintained at the same temperature, $h4 = h5 = h6 = h$, and therefore equations 18 and 19 reduce to the following:

$$V_5 = h \ln (I_5/I_4) \quad (20)$$

$$V_6 = h \ln (I_6/I_4) \quad (21)$$

Thus, it is shown that the two output voltages of the log converter, $V_5$ and $V_6$, are logarithmic functions of the two input signal currents, $I_5$ and $I_6$, respectively. Moreover, the highly temperature variable bulk saturation currents, $Is_5$ and $Is_6$, of the junctions of diode connected transistors Q5 and Q6, respectively, are effectively eliminated from the expressions for the logarithmic converter output voltages $V_5$ and $V_6$ as a result of the temperature compensation effect of the base-emitter junction of transistor Q4 in the feedback loop of amplifier 36.

When these two voltages, $V_5$ and $V_6$, are applied to input terminals 24 and 25 and thereby to the bases of transistors Q2 and Q3 respectively, the equations 20 and 21 are substituted for $V_2$ and $V_3$ respectively in equation 15 to obtain the following new expression for the output signal:

$$Io = (I_1/I_4)\, e^{-V_1/h} \quad (I_6 - I_5) \quad (22)$$

Thus the output current $Io$ is an exact linear product of the reference current $I_1$, (which may be itself a variable input control current or a linear function of an input control voltage), the antilog of the control voltage $V_1$, and the difference between the two input signal currents, $I_6 - I_5$.

In order for this circuit configuration to operate properly, the input signal currents, $I_5$ and $I_6$, as well as the control and reference currents, $I_1$ and $I_4$, may only be of one polarity. In practical applications, however, the input signal currents are often of either polarity. In order for the circuit of FIG. 1 to accommodate bipolar input signals, a constant current, referred to hereafter as $I_7$, with a magnitude on the same order as $I_4$, is sourced into each of the signal input terminals 39 and 40. The bipolar input signal current $I_5$ is also sourced into input terminal 39 and thereby summed with the current $I_7$ into that input; likewise the bipolar input current $I_6$ is sourced into input terminal 40 thereby being summed with the current $I_7$ into that input. When the input currents, $I_5 + I_7$ and $I_6 + I_7$, are substituted for $I_5$ and $I_6$ respectively in equation 22, the resulting expression for the output current is identical to equation 22, but the input signal currents $I_5$ and $I_6$ may be of either polarity instead of being restricted to the one polarity. The positive or negative magnitude excursions of $I_5$ and $I_6$ are only limited to values such that the sums, $I_5 + I_7$ and $I_6 + I_7$, always remain of the one polarity necessary for proper circuit operation.

If the input signals are voltages rather than currents, these voltages may be converted to the currents $I_5$ and $I_6$ by applying the voltages to resistors connected to the respective input terminals, 39 and 40. As this conversion will not be exactly linear, the signal input voltages should be much larger than the junction voltages across diode connected transistors Q5 and Q6. Better conversion accuracies may be obtained with use of any conventional voltage to current converter.

The circuit of FIG. 1 may also be arranged to respond to just a single ended current instead of a differential current by connecting one of the bases of transistors Q2 or Q3 to ground and connecting the other base to one of the outputs of the log converter. For example, the base of transistor Q2 is grounded by grounding input terminal 24, the single ended current $I_6$ is sourced into input terminal 40 and thereby through diode connected transistor Q6, and the resulting output voltage $V_6$ at output terminal 40 is applied to input terminal 25 and thereby to the base of transistor Q3.

By a similar procedure as above, the output current may be expressed as:

$$Io = I_1\, e^{-V_1/h} \quad (I_6/I_4 - 1) \quad (23)$$

Thus, the output current in this mode is also a linear product of the input signal current $I_6$, the control $I_1$, and the antilog of the control voltage $V_1$.

In practical applications, the input current $I_6$ is summed with a reference current equal to $I_4$ before being sourced into input terminal 40. The input current $I_6$ may then be bipolar, where the positive or negative magnitude excursions of $I_6$ are only limited to values such that the total current sourced into input terminal 40 remains of the one polarity necessary for proper circuit operation. This technique furthermore provides a normal multiplier operation, where the output current Io is zero whenever the input signal current $I_6$ is zero.

One advantage of the signal linearization technique described above is that the temperature coefficient $h$ is eliminated from the input signal term, $e^{V_3/h} - e^{V_2/h}$, of equation 15. Only the temperature parameter in the $V_1$ term remains, and this temperature effect may be greatly reduced by use of a temperature compensation resistor in the base circuit of transistor Q1.

Another advantage of using this particular logarithmic converter to linearize the product function is that the circuit is capable of dividing as well as multiplying. Although the current $I_4$ has hereto been regarded as a constant, the current may be a variable input control current, or conversely, the current $I_4$ may be made a function of an input control voltage. If a control voltage, $V_7$, is applied to a resistor with value R2 connected to the inverting input terminal 37 of amplifier 36, which is at a virtual ground, the current $I_4$ through the transistor Q4 may be expressed as:

$$I_4 = V_7/R_2 \tag{24}$$

Upon substitution of this expression for $I_4$ in equation 22, and equation 16 for $I_1$ in equation 22, the new equation for the output current becomes:

$$Io = (R_2/R_1).\ (V_4/V_7).\ e^{-V_1/h}\ (I_6 - I_5) \tag{25}$$

In either case, that expressed by equation 22 or that expressed by equation 25, the output current is an exact linear product of the ratio between two control currents, $I_1$ and $I_4$, or two control voltages, $V_4$ and $V_7$, the antilog of the control voltage $V_1$, and the differential input signal current, $I_6$–$I_5$.

Figure 2:
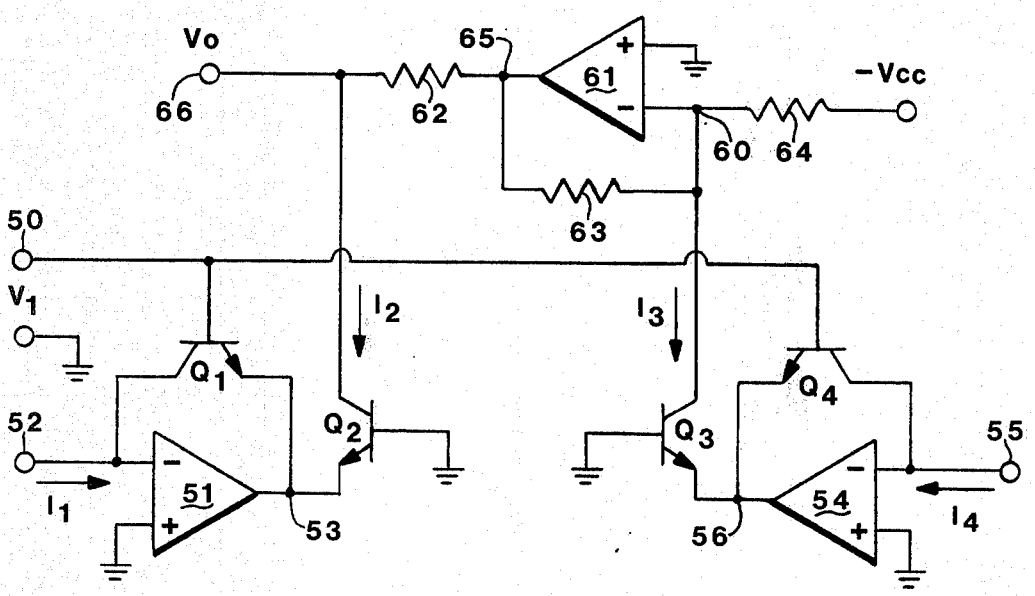
FIG. 2 is a schematic circuit diagram of yet another embodiment of the present invention.

Referring now to FIG. 2, there is shown a general schematic diagram of another embodiment of the present invention, including Q2 and Q3 as the basic multiplying transistor pair, including operational amplifier 51 in conjunction with transistor Q1, and operational amplifier 54 in conjunction with transistor Q4 providing the temperature compensation means and the logarithmic conversion means for the input signal currents $I_1$ and $I_4$ respectively, and including operational amplifier 61 and associated circuitry providing the collector signal differencing means, whereby all four transistors are electrically matched to each other and are all mounted on a common substrate. Not shown are the plus and minus power supply voltages providing power to the operational amplifiers. The following is a detailed description and mathematical derivation of this circuit in accordance with the principles of the present invention.

The input control voltage, $V_1$, is applied with respect to ground to input terminal 50 and thereby to the bases of transistors Q1 and Q4. An input signal current, $I_1$, to be multiplied by the antilog of $V_1$, is sourced into input terminal 52 and thereby into the inverting input of operational amplifier 51, which because of its high gain and low input bias currents will maintain the current $I_1$ through the base-emitter junction of transistor Q1 regardless of the emitter current of transistor Q2. In a similar fashion, another current, $I_4$, which may be either a constant reference current or a second signal input current to be multiplied by the antilog of $V_1$, is sourced into input terminal 55 and thereby into inverting input of operational amplifier 54, which because of its high gain and low input bias currents will maintain current $I_4$ through the base-emitter junction of transistor Q4 regardless of the emitter current of transistor Q3. The output 53 of amplifier 51 will be the sum of the control voltage $V_1$ and the base-emitter junction voltage of transistor Q1, this junction voltage being a logarithmic function of the signal current $I_1$; the output 56 of amplifier 54 will be the sum of the control voltage $V_1$ and the base-emitter junction voltage of transistor Q4, this junction voltage being a logarithmic function of the signal current $I_4$. These two summed voltages at outputs 53 and 56 are applied to the emitters of transistors Q2 and Q3 respectively, thereby becoming the base-emitter junction voltages of transistors Q2 and Q3 respectively by virtue of the fact that the bases of both of these transistors are grounded. Thus, the control voltage $V_1$ is effectively applied simultaneously with equal magnitude and polarity across the base-emitter junctions of transistors Q2 and Q3.

The circuit configurations of transistors Q1 and Q4 connected in the feedback loops of amplifiers 51 and 54 respectively serve two purposes: One purpose is temperature compensation, whereby since transistors Q1, Q2, Q3, and Q4 all exhibit the same electrical characteristics and the base-emitter junctions of which are all maintained at the same temperature, the base-emitter junctions of transistors Q1 and Q4 act to eliminate the temperature effect of the bulk saturation currents on the collector currents of transistors Q2 and Q3 respectively. The second purpose of this particular circuit configuration is the logarithmic conversions of the input signal currents, $I_1$ and $I_4$, whereby the logarithm of $I_1$ is generated as the base-emitter junction voltage of transistor Q1, summed with the input control voltage $V_1$, and applied across the base-emitter junction of transistor Q2, and the logarithm of $I_4$ is generated as the base-emitter voltage of transistor Q4, summed with the input control voltage $V_1$, and applied across the base-emitter junction of transistor Q3. Thus in essence, the logarithms of the input signal currents, which are to be multiplied by the antilog of $V_1$, are applied differentially across the base-emitter junctions of transistors Q2 and Q3.

Since the base-emitter junction voltages of transistors Q1, Q2, Q3 and Q4 are logarithmic functions of the currents through their respective junctions, the expressions for the collector currents of transistors Q2 and Q3 may be written as:

$$h_2\ ln\ (I_2/Is_2) = h_1\ ln\ (I_1/Is_1) - V_1 \tag{26}$$

$$h_3\ ln\ (I_3/Is_3) = h_4\ ln\ (I_4/Is_4) - V_1 \tag{27}$$

where $I_2$ is the collector current of transistors Q2, and $I_3$ is the collector current of transistors Q3 and $Is_1$, $Is_2$, $Is_3$, and $Is_4$ are the bulk saturation currents of the base-emitter junctions of transistors Q1, Q2, Q3, and Q4 respectively. Since transistors Q1, Q2, Q3, and Q4 are all electrically matched to each other, $Is_1 = Is_2 = Is_3 = Is_4$, and since the base-emitter junctions of all four transistors are maintained at the same temperature, $h_1 = h_2 = h_3 = h_4 = h$, and equations 26 and 27 therefore reduce to the following:

$$I_2 = I_1\ e^{-V_1/h} \tag{28}$$

$$I_3 = I_4\ e^{-V_1/h} \tag{29}$$

The collector current $I_3$ of transistor Q3 is fed into the inverting input 60 of operational amplifier 61 which converts this current to a voltage opposite in polarity to that of the current. The collector current $I_2$ of transistor Q2 is fed through resistor 62 and thereby converted to a voltage with a polarity equal to that of this current. Since resistor 62 is connected to the low impedance output of amplifier 61, the collector voltage of transistor Q2 is effectively summed with the voltage at the output 65 of amplifier 61, this summed voltage appearing at the final circuit output terminal 66. Therefore, the final output voltage Vo at terminal 66 consists of the difference between the collector signals of transistors Q2 and Q3, and may be expressed as:

$$Vo = R_1 I_3 - R_2 I_2 \quad (30)$$

where $R_1$ is the value of resistor 63 and $R_2$ is the value of resistor 62. If $R_1 = R_2 = R$, and equations 28 and 29 are substituted for $I_2$ and $I_3$ in equation 30, the output voltage may be expressed by the following equation:

$$Vo = R\, e^{-V_{1/h}} \quad (I_4 - I_1) \quad (31)$$

Thus the output voltage is an exact linear product of the differential input signal current, $I_4 - I_1$, and the antilog of the control voltage $V_1$. Since the output voltage Vo cannot become negative in this particular circuit configuration, resistor 64 biases the quiescent output voltage midway between zero and the maximum positive voltage excursion of amplifier 61. If the input signals to be multiplied are voltages rather than currents, these voltages may be linearly converted to the currents, $I_1$ and $I_4$, by applying them to resistors connected to the inverting input terminals 52 and 55 respectively of amplifiers 51 and 54 respectively.

Figure 3:
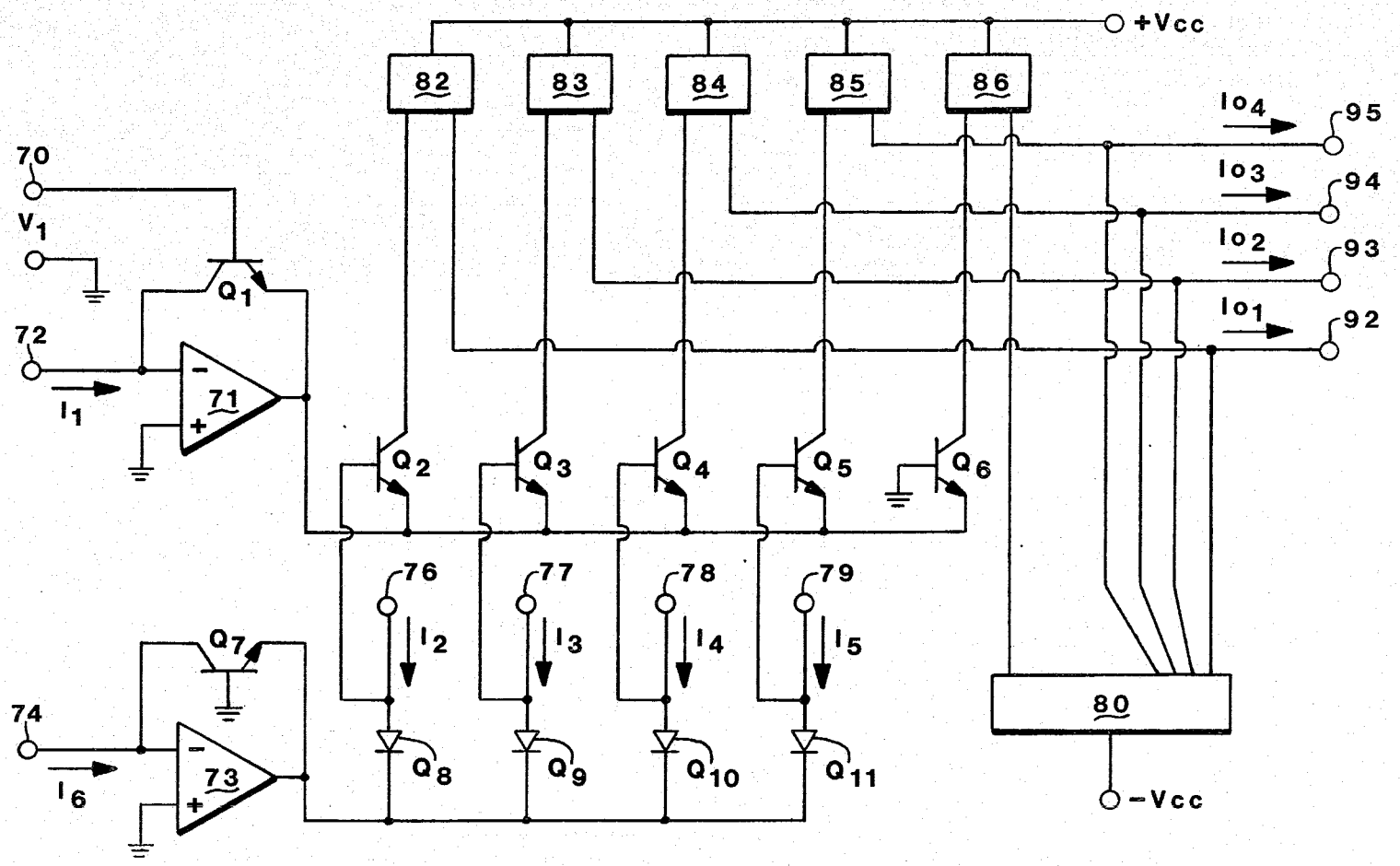
FIG. 3 is a schematic circuit diagram illustrating an embodiment of the present invention as extended in a multiple ganged multiplier configuration.

Referring now to FIG. 3, there is shown an embodiment of a ganged multiplier utilizing the scope of the present invention. This quadruple output multiplier is simply an extension of the embodiment of FIG. 1. The input control voltage, $V_1$, which is applied to input terminal 70 and thereby to the base of transistor Q1, is summed with the base-emitter voltage of Q1 generated by the current, $I_1$, which is sourced into input terminal 72 and thereby to the inverting input of operational amplifier 71, and this sum is applied simultaneously to the emitters of transistors Q2, Q3, Q4, Q5, and Q6 by means of the circuit configuration consisting of transistor Q1 and amplifier 71 which serves to temperature compensate the collector currents of transistors Q2, Q3, Q4, Q5, and Q6 and to provide the logarithmic conversion of the input control current $I_1$. The signal input currents $I_2$, $I_3$, $I_4$, and $I_5$ are applied to the input terminals 76, 77, 78, and 79 respectively of the temperature compensated logarithmic converter consisting of transistor Q7, operational amplifier 73, and diodes Q8, Q9, Q10, and Q11. A current $I_6$ is sourced into terminal 74 and thereby to the inverting input of amplifier 73. The corresponding outputs of the log converter at terminals 76, 77, 78, and 79 are applied to the bases of transistors Q2, Q3, Q4, and Q5 respectively. The collector current of transistor Q6, the base of which is grounded, is inverted by current mirror 86 and then reinverted by the multiple output current mirror 80 which provides four independent output currents, each equal to the collector current of transistor Q6. The collector currents of transistors Q2, Q3, Q4, and Q5 are inverted by current mirrors 82, 83, 84, and 85 respectively. Each of these inverted currents is then added to one of the multiple output currents of current mirror 80 to form the final output currents at output terminals 92, 93, 94, and 95 respectively. By the methods herein previously described, these output currents at terminals 92, 93, 94 and 95 may be expressed by the following respective relationships:

$$Io_1 = I_1\, e^{-V_{1/h}} \quad (I_2/I_6 - 1)$$

$$Io_2 = I_1\, e^{-V_{1/h}} \quad (I_3/I_6 - 1)$$

$$Io_3 = I_1\, e^{-V_{1/h}} \quad (I_4/I_6 - 1)$$

$$Io_4 = I_1\, e^{-V_{1/h}} \quad (I_5/I_6 - 1) \quad (33)$$

Thus a multiple ganged product function is generated with the use of relatively few elements.

Since certain changes may be made in the above apparatus without departing from the scope of the invention herein involved, it is intended that all matter contained in the above description or shown in the accompanying drawings shall be interpreted as illustrative and not in the limiting sense.

What is claimed is:

1. A device for generating an output signal which is proportional to the product of two input voltages, said device comprising:

first and second semiconductor elements each having a diode junction with operating characteristics such that a current passed through said junction is substantially an exponential function of a voltage across said junction;

means for algebraically summing said two input voltages and applying said sum across the diode junction of one of said semiconductor elements, means for applying one of said voltages across the diode junction of the other of said semiconductor elements; and differencing means for generating a signal proportional to the difference between the currents passed through the junctions of said first and second elements, whereby said generated signal is proportional to the product of said two input voltages.

2. The device of claim 1 wherein said product is the linear product between one of said input voltages and the antilogarithm of the other of said input voltages.

3. The device of claim 1 further including a logarithmic conversion means for generating one of said input voltages as a logarithmic function of a first input signal.

4. The device of claim 3 including a second logarithmic conversion means for generating the other of said input voltages as a logarithmic function of a second input signal.

5. The device of claim 3 wherein said product is the linear product between said first input signal and one of said input voltages.

6. The device of claim 3 wherein said product is the linear product between said first input signal and the antilogarithm of one of said input voltages.

7. The device as set forth in claim 1 wherein said elements are diodes.

8. The device as set forth in claim 1 wherein said elements are transistors.

9. The device as set forth in claim 1 wherein said elements are matched to exhibit substantially the same electrical characteristics and including means to maintain said diode junctions of said elements at substantially the same temperature.

10. The device as set forth in claim 1 and including means to substantially eliminate the variations of the currents through the diode junctions of said elements as a function of the variations in the temperature of the diode junctions of said elements.

11. The device of claim 1 further including a second means for algebraically summing one of said two input voltages with a third input voltage and applying said sum across the diode junction of said other of said semiconductor elements whereby said output signal is proportional to the product of said one of said two input voltages and the difference between the other of said two input voltages and said third input voltage.

12. An analog device for generating an output signal which is proportional to the linear product between a first input signal, the difference between a third and fourth input signal and the antilogarithm of a second input voltage, said device comprising in combination:

first, second, and third transistors matched to exhibit the same electrical characteristics and having base-emitter junctions which are maintained at the same temperature;

means connected for supplying a forward current which is a linear function of said first input signal through the base-emitter junction of said first transistor;

means connected for summing the base-emitter junction voltage of said first transistor due to said forward current with a said second input voltage;

means connected for applying the summed voltages simultaneously to the emitters of said second and third transistors so as to generate a forward current through the collector of said second transistor and through the collector of said third transistor without affecting said forward current through the base-emitter junction of said first transistor;

means connected for applying a voltage which is a function of said third input signal to the base of said second transistor so as to sum across the base-emitter junction of said second transistor said voltage as a function of said third input signal with said summed voltage applied to the emitter of said second transistor;

means connected for applying a voltage which is a function of said fourth input signal to the base of said third transistor so as to sum across the base-emitter junction of said third transistor said voltage as a function of said fourth input signal with said summed voltage applied to the emitter of said third transistor; and differencing means for generating a signal which is proportional to the difference between the currents passed through the collectors of said second and third transistors whereby said generated signal is comprised solely of the product of said first input signal, the difference between said third and fourth input signals and the antilog of said second input voltage.

13. An analog device as set forth in claim 12 wherein said differencing means is comprised of a plurality of current mirrors arranged such that said output signal is a current equal to the difference between said currents passed through the collectors of said second and third transistors.

14. An analog device as set forth in claim 12 wherein said functions of said third and fourth input signals are linear and said voltage applied to the bases of said second and third transistors are maintained small compared to the base-emitter junction voltages of said second and third transistors so as to maintain the deviation of the output signal from the ideal of said product to an acceptably small figure.

15. An analog device as set forth in claim 12 wherein said functions of said third and fourth input signals are logarithmic.

16. An analog device as set forth in claim 15 wherein said logarithmic functions are generated by a circuit comprising in combination:

first, second, and third diode junctions matched to exhibit the same electrical characteristics and maintained at the same temperature;

means connected for supplying a forward current which is a linear function of a fifth input signal through said first diode junction;

means connected for supplying current which is a linear function of said third input signal through said second junction;

means connected for supplying a current which is a linear function of said fourth input signal through said third diode junction so as to generate voltages across said second and third diode junctions which are substantially logarithmic functions of said third and fourth input signals respectively;

means connected for differencing the voltage across said first diode junction with the voltage across said second diode junction, and for differencing the voltage across said first diode junction with the voltage across said third diode junction, without affecting said forward current through said first diode junction; and means connected for applying said difference between said first and second diode junction voltages to the base of said second transistor, and for applying said difference between said first and third diode junction voltages to the base of said third transistor, so as to generate an output signal of said device which is proportional to the linear product between the antilog of said second input voltage, the ratio between said first and fifth input signals and the difference between said third and fourth input signals.

17. An analog device for generating an output signal which is the linear product between the antilog of a first input voltage and the difference between a second and third input signal, said device comprising in combination:

first, second, third, and fourth transistors all matched to exhibit the same electrical characteristics and having base-emitter junctions which are maintained at the same temperature;

means connected for supplying a forward current which is a linear function of said second input signal through the base-emitter junction of said first transistor;

means connected for supplying a current which is a linear function of said third input signal through the base-emitter junction of said fourth transistor, means connected for algebraically summing said first input voltage with the base-emitter junction voltage of said first transistor due to said forward current as a function of said second input signal, means connected for applying said sum across the base-emitter junction of said second transistor so as to generate a current through the collector of said second transistor without affecting said current through the base-emitter junction of said first transistor;

means connected for algebraically summing said first input voltage with the base-emitter junction voltage of said fourth transistor due to said forward current as a function of said third input signal;

means connected for applying said sum across the base-emitter junction of said third transistor so as to generate a current through the collector of said third transistor without affecting said current through said base-emitter junction of said fourth transistor; and differencing means for generating a signal which is proportional to the difference between the currents passed through the collectors of said second and third transistors whereby said generated signal is comprised solely of the product between the antilog of said first input voltage and the difference between said second and third input signals.

18. An analog device for generating simultaneously a plurality of independent output signals, whereby each output signal is the product of a common input signal and one of a plurality of input signals, said device comprising in combination:

a plurality of transistors, means connected for generating a plurality of sums, each being the sum of a voltage as a function of said common input signal and one of a plurality of voltages, means for applying each of said sums across the base-emitter junction of one of said plurality of transistors wherein the currents passed through the collectors of said plurality of transistors due only to said voltage as a function of said common input signal are equal in magnitude and wherein each of said plurality of voltages is a function of one of a pair of signal components, said pair of signal components comprising one of said plurality of input signals to be multiplied by said common input signal, differencing means connected for simutaneously generating each of a plurality of signals proportional to the difference between the current passed through the collector of one of said plurality of transistors, the base-emitter junction of which is being driven by a voltage as a function of one of a pair of signal components and the current passed through the collector of another of said plurality of transistors the base-emitter junction of which is being driven by a voltage as a function of the other of said pair of signal components, whereby said pair of signal components comprises one of said plurality of input signals multiplied by said common input signal, whereby each of said generated signals is proportional to the product of said common input signal and one of said plurality of input signals.

19. An analog device as set forth in claim 18 wherein one or more pairs of said plurality of transistors are matched to exhibit the same electrical characteristics and including means to maintain the base-emitter junctions of which at the same temperature.

20. An analog device as set forth in claim 18 and including means to substantially eliminate the variations of the currents passed through the collectors of said plurality of transistors as a function of the variations in the temperature of the base-emitter junctions of said plurality of transistors.

21. An analog device as set forth in claim 18 wherein either one of any pair of said signal components comprising one of said plurality of input signals is zero.

22. An analog device as set forth in claim 18 wherein said function of said common input signal is linear.

23. An analog device as set forth in claim 18 wherein said function of said common input signal is logarithmic.

24. An analog device as set forth in claim 18 wherein said function of any of said signal components comprising said plurality of input signals is linear..

25. An analog device as set forth in claim 18 wherein said function of any of said signal components comprising said plurality of input signals is logarithmic.

26. An analog device as set forth in claim 18 wherein said product is the linear product between said common input signal and one of said plurality of input signals.

27. An analog device as set forth in claim 18 wherein said product is the linear product between one of said plurality of input signals and the antilog of said common input signal.

28. An analog device as set forth in claim 18 wherein said means for generating said plurality of difference signals is comprised of a plurality of current mirrors arranged such that each of said plurality of output signals is equal to the difference between said currents passed through the collectors of a pair of said plurality of transistors.

* * * * *